US007622012B2

(12) United States Patent
Uozumi et al.

(10) Patent No.: US 7,622,012 B2
(45) Date of Patent: Nov. 24, 2009

(54) FLAT SOFT MAGNETIC METAL POWDER AND COMPOSITE MAGNETIC MATERIAL INCLUDING THE SOFT MAGNETIC METAL POWDER

(75) Inventors: Gakuji Uozumi, Mito (JP); Ryoji Nakayama, Kashiwa (JP); Yasushi Nayuki, Choshi (JP)

(73) Assignee: Mitsubishi Materials Corporation, Tokyo (JP)

( * ) Notice: Subject to any disclaimer, the term of this patent is extended or adjusted under 35 U.S.C. 154(b) by 13 days.

(21) Appl. No.: 11/815,685

(22) PCT Filed: Feb. 9, 2006

(86) PCT No.: PCT/JP2006/302269

§ 371 (c)(1),
(2), (4) Date: Aug. 7, 2007

(87) PCT Pub. No.: WO2006/085593

PCT Pub. Date: Aug. 17, 2006

(65) Prior Publication Data

US 2009/0025830 A1 Jan. 29, 2009

(30) Foreign Application Priority Data

Feb. 9, 2005 (JP) ..... 2005-032421
Feb. 9, 2005 (JP) ..... 2005-033142

(51) Int. Cl.
*H01F 1/147* (2006.01)

(52) U.S. Cl. ..... 148/312; 148/425; 420/441; 420/459; 420/460

(58) Field of Classification Search ..... None
See application file for complete search history.

(56) References Cited

U.S. PATENT DOCUMENTS

| | | | | |
|---|---|---|---|---|
| 4,710,243 | A | 12/1987 | Masumoto et al. | |
| 5,135,586 | A | 8/1992 | Meguro et al. | |
| 5,258,681 | A | 11/1993 | Hibino et al. | |
| 5,496,419 | A | 3/1996 | Murakami et al. | |
| 6,919,387 | B2 * | 7/2005 | Fujieda et al. | 523/137 |

FOREIGN PATENT DOCUMENTS

| | | | |
|---|---|---|---|
| JP | 48-29970 | | 9/1973 |
| JP | 61-174349 | A1 | 8/1986 |
| JP | 61-252617 | A | 11/1986 |
| JP | 1-127638 | A | 5/1989 |
| JP | 1-294801 | A | 11/1989 |
| JP | 1-298101 | A | 12/1989 |
| JP | 3-232574 | A | 10/1991 |
| JP | 4-078112 | A | 3/1992 |
| JP | 5-98301 | A | 4/1993 |
| JP | 7-252604 | A | 10/1995 |
| JP | 9-168252 | A | 6/1997 |
| JP | 10-259439 | A | 9/1998 |
| WO | 2005/011899 | A1 | 2/2005 |

* cited by examiner

*Primary Examiner*—John P. Sheehan
(74) *Attorney, Agent, or Firm*—Darby & Darby P.C.

(57) ABSTRACT

A flat soft magnetic metal powder is provided that includes: Ni in the range of 60 to 90 mass %, one or more kinds of Nb, V, and Ta in the range of 0.05 to 20 mass % in total (0.05 to 19.95 mass % when Mo is added thereto), Mo in the range of 0.05 to 10 mass % if necessary, one or two kinds of Al and Mn in the range of 0.01 to 1 mass % in total if necessary, and the balance including Fe; an average grain size of 30 to 150 μm and an aspect ratio (average grain size/average thickness) of 5 to 500; and a flat face. Here, with a peak intensity of a face index (220) in an X-ray diffraction pattern $I_{220}$ and a peak intensity of a face index (111) $I_{111}$, a peak intensity ratio $I_{220}/I_{111}$ is in the range of 0.1 to 10.

25 Claims, No Drawings

FLAT SOFT MAGNETIC METAL POWDER AND COMPOSITE MAGNETIC MATERIAL INCLUDING THE SOFT MAGNETIC METAL POWDER

CROSS REFERENCE TO PRIOR RELATED APPLICATIONS

This application is a U.S. national phase application under 35 U.S.C. §371 of International Patent Application No. PCT/JP2006/302269, filed on Feb. 9, 2006, and claims the benefit of and priority from Japanese Patent Application Nos. 2005-032421 and 2005-033142, both filed on Feb. 9, 2005, the content of all three of which is incorporated by reference herein. The International Application was published in Japanese on Aug. 17, 2006 as International Publication No. WO 2006/085593 A1 under PCT Article 21(2).

FIELD OF THE INVENTION

The present invention relates to a flat soft magnetic metal powder with high hardness and high permeability used as a radio wave absorber or a high-frequency magnetic material and an oxide-coated flat soft magnetic metal powder in which the surface of the flat soft magnetic metal powder with high hardness and high permeability is coated with an oxide film. The flat soft magnetic metal powder or the oxide-coated flat soft magnetic metal powder with high hardness and high permeability is oriented and dispersed in a resin for use as a composite magnetic material of a composite magnetic sheet.

BACKGROUND OF THE INVENTION

In general, Permalloy A (Fe-70~80% Ni) (where % denotes mass %. The same is true in the following description) is known as a high-permeability soft magnetic material for ingot materials and sintering materials. However, when the material is heated and then is slowly cooled, the material forms a $FeNi_3$ ordered phase and the crystal magnetic anisotropy constant $K_1$ is negative with a large absolute value. It is known that the <111> direction is a direction of easy magnetization and the <100> direction is a direction of difficult magnetization when the crystal magnetic anisotropy constant $K_1$ is negative, the <100> direction is a direction of easy magnetization and the <111> direction is a direction of difficult magnetization when the crystal magnetic anisotropy constant is positive, and the material is magnetically isotropic when the crystal magnetic anisotropy constant is 0. The magnetic anisotropy is generated due to the formation of the $FeNi_3$ ordered phase, thereby decreasing permeability in usual polycrystalline substances in which crystal planes are not oriented but are isotropic in crystal orientation. In order to obtain high permeability in the material, it is necessary to quench the material after heating the material at a high temperature, or to perform an additional aging process thereafter. Accordingly, the material is hardly used industrially.

For this reason, there has been suggested an Fe—Ni—(Nb, V, Ta)-based alloy obtained by adding one kind or two or more kinds of Nb, V, and Ta in the range of 0.05 to 20 mass % in total to the permalloy. Fe—Ni—Mo-based alloys such as a Mo permalloy (Fe-79% Ni-4% Mo) and a supermalloy (Fe-79% Ni-5% Mo) in which Mo is added to the permalloy are also known. By the addition of (Nb, V, Ta) or the addition of Mo, the formation of the $FeNi_3$ ordered phase is suppressed even when the materials are rapidly cooled after being heated, the crystal magnetic anisotropy constant $K_1$ is approximately 0 more or less even when they are not rapidly cooled after being heated, and thus the materials exhibit high permeability in the polycrystalline substance isotropic in crystal orientation. Accordingly, such materials are widely used industrially.

High-permeability soft magnetic materials in which Cu, Cr, and Mn are added thereto to further enhance the permeability are known (see Japanese Unexamined Patent Application, First Publication No. Hei 9-168252; Japanese Unexamined Patent Application, First Publication No. Hei 7-252604; and Japanese Unexamined Patent Application, First Publication No. Hei 1-298101 (JP '101)).

High-permeability soft magnetic materials in which Cu, Cr, and Mn are added in addition to Nb, V, and Ta to further enhance the permeability are also known.

Fe—Ni—Mo-based flat soft magnetic metal powders which are obtained by flattening powders having the same composition are also known.

For example, a flat soft magnetic metal powder having a composition of Fe-70~83% Ni-2~6% Mo-3~6% Cu-1~2% Mn and having an average grain size in the range of 0.1 to 30 μm and an average thickness of 2 μm or less is known. It is known that the flat soft magnetic metal powder is used as a magnetic-card flat soft magnetic metal powder (see Japanese Unexamined Patent Application, First Publication No. Hei 3-223401).

A flat flake-shaped soft magnetic powder having a composition of Fe-40~80% Ni-2~6% Mo is also known. It is known that the flat flake-shaped soft magnetic powder is used as a magnetic-label soft magnetic powder (see Japanese Unexamined Patent Application, First Publication No. Hei 3-232574).

A flat soft magnetic metal powder having a composition of Fe-60~80% Ni or Fe-60~80% Ni-5% (or less) Mo is also known. It is known that the flat soft magnetic metal powder is used as a high-frequency magnetic core (see Japanese Unexamined Patent Application, First Publication No. Hei 4-78112).

It is known that the above-mentioned Fe—Ni—(Nb, V, Ta)-based or Fe—Ni—Mo-based flat soft magnetic metal powders can further enhance magnetic characteristics such as permeability in the flat faces of the powders by flattening the Fe—Ni—(Nb, V, Ta)-based or Fe—Ni—Mo-based powders, which are obtained by general pulverization or atomization, into a flat shape and revealing shape magnetic anisotropy by a demagnetizing field to use the flat face as a face of easy magnetization.

The known Fe—Ni—(Nb, V, Ta)-based or Fe—Ni—Mo-based flat soft magnetic metal powders are produced by adding ethanol or water as a solvent to the Fe—Ni—(Nb, V, Ta)-based or Fe—Ni—Mo-based soft magnetic powders which are obtained by general pulverization or atomization, adding a pulverizing agent thereto if necessary, and flattening the mixture by the use of an attritor or a ball mill.

The Fe—Ni—(Nb, V, Ta)-based and Fe—Ni—Mo-based flat soft magnetic metal powders produced in the above-mentioned manner are dispersed in a resin so that the flat surfaces are oriented, thereby producing a composite magnetic material. When the composite magnetic material is a composite magnetic sheet, the flat surfaces of the Fe—Ni—(Nb, V, Ta)-based and Fe—Ni—Mo-based flat soft magnetic metal powders are oriented in a direction perpendicular to the thickness direction of the composite magnetic sheet (see JP '101).

SUMMARY OF THE INVENTION

However, since the known Fe—Ni—(Nb, V, Ta)-based flat soft magnetic metal powders are poor in permeability, there is a need for an Fe—Ni—(Nb, V, Ta)-based flat soft magnetic metal powder having higher permeability.

Since the known Fe—Ni—Mo-based flat soft magnetic metal powders are poor in permeability, a radio wave absorber or a high-frequency magnetic material formed of the known Fe—Ni—Mo-based flat soft magnetic metal powders does not have sufficient characteristics. Since the known Fe—Ni—Mo-based flat soft magnetic metal powders are poor in hardness, the known Fe—Ni—Mo-based flat soft magnetic metal powders can be easily bent at the time of forming the composite magnetic sheet by mixing the known Fe—Ni—Mo-based flat soft magnetic metal powders with a binder such as a resin and press-shaping the mixture. Accordingly, there is a problem in that a ratio of the Fe—Ni—Mo-based flat soft magnetic metal powders, the flat face of which is oriented in a direction perpendicular to the thickness direction of the composite magnetic sheet, is reduced, thereby not achieving sufficient characteristics for the high-frequency magnetic material.

The invention is made to solve the above-mentioned problems. An object of the invention is to provide a flat soft magnetic metal powder with high permeability and a composite magnetic material using the flat soft magnetic metal powder.

Therefore, the inventors have studied to further enhance the permeability of the known Fe—Ni—(Nb, V, Ta)-based flat soft magnetic metal powder and thus to obtain a flat soft magnetic metal powder which can be used to form a radio wave absorber or a high-frequency magnetic material having excellent characteristics. The inventors have also studied to obtain a flat soft magnetic metal powder which has permeability and hardness higher than those of the known Fe—Ni—(Nb, V, Ta)-based flat soft magnetic metal powder and can be thus used to form a radio wave absorber or a high-frequency magnetic material having excellent characteristics. As a result of the studies, the following findings were made.

When an Fe—Ni—(Nb, V, Ta)-based soft magnetic metal powder including a component composition which includes Ni in the range of 60 to 90 mass %, one kind or two or more kinds of Nb, V, and Ta in the range of 0.05 to 20 mass % in total, and the balance including Fe and inevitable impurities, or an Fe—Ni—Mo—(Nb, V, Ta)-based soft magnetic metal powder including a component composition which includes Ni in the range of 60 to 90 mass %, Mo in the range of 0.05 to 10 mass %, one kind or two or more kinds of Nb, V, and Ta in the range of 0.05 to 19.95 mass % in total, and the balance including Fe and inevitable impurities, is flattened with a solvent having high viscosity using an attritor or a ball mill, pulverization, which can easily occur at the time of the flattening process, is suppressed due to the hardness of the powder. Accordingly, it is possible to obtain an Fe—Ni—(Nb, V, Ta)-based or Fe—Ni—Mo—(Nb, V, Ta)-based flat soft magnetic metal powder which is small in thickness and large in size. A peak intensity ratio $I_{220}/I_{111}$ of the Fe—Ni—(Nb, V, Ta)-based or Fe—Ni—Mo—(Nb, V, Ta)-based flat soft magnetic metal powder obtained in the above-mentioned manner is in the range of 0.1 to 10, where a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the flat soft magnetic metal powder and an angle formed by the incidence direction and the flat face is equal to an angle formed by the diffraction direction and the flat face. The Fe—Ni—(Nb, V, Ta)-based or Fe—Ni—Mo—(Nb, V, Ta)-based soft magnetic metal powder of which the peak intensity ratio $I_{220}/I_{111}$ is in the range of 0.1 to 10 has enhanced hardness and permeability.

The Fe—Ni—(Nb, V, Ta)-based flat soft magnetic metal powder is generally poor in workability, since it has high hardness. The Fe—Ni—Mo—(Nb, V, Ta)-based alloy having a component composition which includes Ni in the range of 60 to 90 mass %, Mo in the range of 0.05 to 10 mass %, one kind or two or more kinds of Nb, V, and Ta in the range of 0.05 to 19.95 mass % in total, and the balance including Fe and inevitable impurities is poor in workability, since it has high hardness. When the Fe—Ni—(Nb, V, Ta)-based or Fe—Ni—Mo—(Nb, V, Ta)-based flat soft magnetic metal powder which is poor in workability is intended to be flattened using an attritor or a ball mill, the advance time of flattening is large and it is pulverized to reduce an aspect ratio thereof by performing the flattening process for a long time. However, since the workability is improved by adding one or two kinds of Al and Mn to the Fe—Ni—(Nb, V, Ta)-based or Fe—Ni—Mo—(Nb, V, Ta)-based alloy, it is preferable that one or two kinds of Al and Mn be added in the range of 0.01 to 1 mass % if necessary.

The inventors found that the permeability in the flat face of the Fe—Ni—(Nb, V, Ta)-based or Fe—Ni—Mo—(Nb, V, Ta)-based flat soft magnetic metal powder is further enhanced by setting the average grain size to the range of 30 to 150 μm and setting the aspect ratio to the range of 5 to 500.

The invention is made based on the above-mentioned findings and provides the following aspects.

One aspect of the invention provides an Fe—Ni—(Nb, V, Ta)-based soft magnetic metal powder (hereinafter, referred to as an Fe—Ni—(Nb, V, Ta)-based flat soft magnetic metal powder) including: a component composition which includes Ni in the range of 60 to 90 mass %, one kind or two or more kinds of Nb, V, and Ta in the range of 0.05 to 20 mass % in total, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the Fe—Ni—(Nb, V, Ta)-based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

Another aspect of the invention provides an Fe—Ni—(Nb, V, Ta)-based soft magnetic metal powder (hereinafter, referred to as an Fe—Ni—(Nb, V, Ta)-based flat soft magnetic metal powder) including: a component composition which includes Ni in the range of 60 to 90 mass %, one kind or two or more kinds of Nb, V, and Ta in the range of 0.05 to 20 mass % in total, one or two kinds of Al and Mn in the range of 0.01 to 1 mass %, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) is $I_{111}$, the X-ray diffraction pattern being measured in a state where a plane including an incidence direction and a diffraction direction of an X ray is perpendicular to the flat face of the Fe—Ni—(Nb, V, Ta)- based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

The Fe—Ni—(Nb, V, Ta)-based flat soft magnetic metal powder is used in a composite magnetic material such as a composite magnetic sheet in a state where it is dispersed in a resin so as to orient the flat face thereof. In the case of the composite magnetic sheet, the flat face of the Fe—Ni—(Nb, V, Ta)-based flat soft magnetic metal powder is oriented in a direction perpendicular to the thickness direction of the composite magnetic sheet.

Another aspect of the invention provides a composite magnetic material including: a resin; and the Fe—Ni—(Nb, V, Ta)-based flat soft magnetic metal powder described above which is dispersed in the resin so as to orient the flat face thereof. It is preferable that the flat face of the Fe—Ni—(Nb, V, Ta)-based flat soft magnetic metal powder be oriented in a direction crossing the thickness direction of a composite magnetic sheet as the composite magnetic material.

Another aspect of the invention provides a composite magnetic sheet including: the composite magnetic material described immediately above, wherein the Fe—Ni—(Nb, V, Ta)-based flat soft magnetic metal powder is dispersed so as to orient the flat face thereof in a direction perpendicular to a thickness direction of the composite magnetic sheet.

The composite magnetic material described above or the composite magnetic sheet described immediately above in which the Fe—Ni—(Nb, V, Ta)-based flat soft magnetic metal powder described further above is dispersed in the resin so as to orient the flat face thereof not only has an excellent characteristic as a radio wave absorber or a high-frequency magnetic material, but also has a characteristic such that an oxide film is hardly formed on the surface thereof because the Fe—Ni—(Nb, V, Ta)-based flat soft magnetic metal powder is permalloy-based. Accordingly, even when the Fe—Ni—(Nb, V, Ta)-based flat soft magnetic metal powder is left in the atmosphere for a long time, the thickness of the oxide film formed on the surface of the Fe—Ni—(Nb, V, Ta)-based flat soft magnetic metal powder is less than 50 Å (5 nm). When the Fe—Ni—(Nb, V, Ta)-based flat soft magnetic metal powder having the thin oxide film is dispersed in a resin with a high density, the Fe—Ni—(Nb, V, Ta)-based flat soft magnetic metal powders are located adjacent to each other. Accordingly, as the density of the dispersed amount of the Fe—Ni—(Nb, V, Ta)-based flat soft magnetic metal powder becomes higher, the resistivity of the composite magnetic material or the composite magnetic sheet to be obtained is decreased.

For this reason, the resistivity may be poor for the composite magnetic material or the composite magnetic sheet and thus there is a need for a composite magnetic material or a composite magnetic sheet having higher resistivity. In order to satisfy the need, it is necessary to form an oxide film having a larger thickness (50 to 1000 Å) on the surface of the Fe—Ni—(Nb, V, Ta)-based flat soft magnetic metal powder described above. The oxide film having a larger thickness can be produced by heating the Fe—Ni—(Nb, V, Ta)-based flat soft magnetic metal powder described above in an oxidizing atmosphere or in warm water and then drying the Fe—Ni—(Nb, V, Ta)-based flat soft magnetic metal powder.

Another aspect of the invention provides an oxide-coated Fe—Ni—(Nb, V, Ta)-based flat soft magnetic metal powder including: an Fe—Ni—(Nb, V, Ta)-based soft magnetic metal powder (hereinafter, referred to as an Fe—Ni—(Nb, V, Ta)-based flat soft magnetic metal powder); and an oxide film having a thickness in the range of 50 to 1000 Å (5 to 100 nm) which is formed on the surface of the Fe—Ni—(Nb, V, Ta)-based flat soft magnetic metal powder, wherein the Fe—Ni—(Nb, V, Ta)-based flat soft magnetic metal powder includes a component composition which includes Ni in the range of 60 to 90 mass %, one kind or two or more kinds of Nb, V, and Ta in the range of 0.05 to 20 mass % in total, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—(Nb, V, Ta)-based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

Another aspect of the invention provides an oxide-coated Fe—Ni—(Nb, V, Ta)-based flat soft magnetic metal powder including: an Fe—Ni—(Nb, V, Ta)-based soft magnetic metal powder (hereinafter, referred to as an Fe—Ni—(Nb, V, Ta)-based flat soft magnetic metal powder); and an oxide film having a thickness in the range of 50 to 1000 Å (5 to 100 nm) which is formed on the surface of the Fe—Ni—(Nb, V, Ta)-based flat soft magnetic metal powder, wherein the Fe—Ni—(Nb, V, Ta)-based flat soft magnetic metal powder includes a component composition which includes Ni in the range of 60 to 90 mass %, one kind or two or more kinds of Nb, V, and Ta in the range of 0.05 to 20 mass % in total, one or two kinds of Al and Mn in the range of 0.01 to 1 mass % in total, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—(Nb, V, Ta)-based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

Another aspect of the invention provides a composite magnetic material including: a resin; and the oxide-coated Fe—Ni—(Nb, V, Ta)-based flat soft magnetic metal powder described above which is dispersed in the resin so as to orient the flat face thereof.

It is preferable that the flat face of the oxide-coated Fe—Ni—(Nb, V, Ta)-based flat soft magnetic metal powder be oriented in a direction crossing the thickness direction of a composite magnetic sheet as the composite magnetic material.

Another aspect of the invention provides a composite magnetic sheet including: the composite magnetic material described immediately above, wherein the oxide-coated Fe—Ni—(Nb, V, Ta)-based flat soft magnetic metal powder is dispersed so as to orient the flat face thereof in a direction perpendicular to a thickness direction of the composite magnetic sheet.

Another aspect of the invention provides an Fe—Ni—Mo—(Nb, V, Ta)-based soft magnetic metal powder (hereinafter, referred to as an Fe—Ni—Mo—(Nb, V, Ta)-based flat soft magnetic metal powder) including: a component composition which includes Ni in the range of 60 to 90 mass %, Mo in the range of 0.05 to 10 mass %, one kind or two or more kinds of Nb, V, and Ta in the range of 0.05 to 19.95 mass % in total, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the Fe—Ni—Mo—(Nb, V, Ta)-based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

Another aspect of the invention provides an Fe—Ni—Mo—(Nb, V, Ta)-based soft magnetic metal powder (hereinafter, referred to as an Fe—Ni—Mo—(Nb, V, Ta)-based flat soft magnetic metal powder) including: a component composition which includes Ni in the range of 60 to 90 mass %, Mo in the range of 0.05 to 10 mass %, one kind or two or more kinds of Nb, V, and Ta in the range of 0.05 to 19.95 mass % in total, one or two kinds of Al and Mn in the range of 0.01 to 1 mass % in total, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the Fe—Ni—Mo—(Nb, V, Ta)-based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

The Fe—Ni—Mo—(Nb, V, Ta)-based flat soft magnetic metal powder is used in a composite magnetic material such as a composite magnetic sheet in a state where it is dispersed in a resin so as to orient the flat face thereof. In the case of the composite magnetic sheet, the flat face of the Fe—Ni—Mo—(Nb, V, Ta)-based flat soft magnetic metal powder is oriented in a direction perpendicular to the thickness direction of the composite magnetic sheet.

Another aspect of the invention provides a composite magnetic material including: a resin; and the Fe—Ni—Mo—(Nb, V, Ta)-based flat soft magnetic metal powder described above which is dispersed in the resin so as to orient the flat face thereof. It is preferable that the flat face of the Fe—Ni—Mo—(Nb, V, Ta)-based flat soft magnetic metal powder be oriented in a direction crossing the thickness direction of a composite magnetic sheet as the composite magnetic material.

Another aspect of the invention provides a composite magnetic sheet including: the composite magnetic material described immediately above, wherein the Fe—Ni—Mo—(Nb, V, Ta)-based flat soft magnetic metal powder is dispersed so as to orient the flat face thereof in a direction perpendicular to a thickness direction of the composite magnetic sheet.

The composite magnetic material described above or the composite magnetic sheet described immediately above in which the Fe—Ni—Mo—(Nb, V, Ta)-based flat soft magnetic metal powder described further above is dispersed in the resin so as to orient the flat face thereof not only has an excellent characteristic as a radio wave absorber or a high-frequency magnetic material, but also has a characteristic such that an oxide film is hardly formed on the surface thereof because the Fe—Ni—Mo—(Nb, V, Ta)-based flat soft magnetic metal powder is permalloy-based. Accordingly, even when the Fe—Ni—Mo—(Nb, V, Ta)-based flat soft magnetic metal powder is left in the atmosphere for a long time, the thickness of the oxide film formed on the surface of the Fe—Ni—Mo—(Nb, V, Ta)-based flat soft magnetic metal powder is less than 50 Å (5 nm). When the Fe—Ni—Mo—(Nb, V, Ta)-based flat soft magnetic metal powder having the thin oxide film is dispersed in a resin with a high density, the Fe—Ni—Mo—(Nb, V, Ta)-based flat soft magnetic metal powders are located adjacent to each other. Accordingly, as the density of the dispersed amount of the Fe—Ni—Mo—(Nb, V, Ta)-based flat soft magnetic metal powder becomes higher, the resistivity of the composite magnetic material or the composite magnetic sheet to be obtained is decreased.

For this reason, the resistivity may be poor for the composite magnetic material or the composite magnetic sheet and thus there is a need for a composite magnetic material or a composite magnetic sheet having higher resistivity. In order to satisfy the need, it is necessary to form an oxide film having a larger thickness (50 to 1000 Å) on the surface of the Fe—Ni—Mo—(Nb, V, Ta)-based flat soft magnetic metal powder described above. The oxide film having a larger thickness can be produced by heating the Fe—Ni—Mo—(Nb, V, Ta)-based flat soft magnetic metal powder described above in an oxidizing atmosphere or in warm water and then drying the Fe—Ni—(Nb, V, Ta)-based flat soft magnetic metal powder.

Another aspect of the invention provides an oxide-coated Fe—Ni—Mo—(Nb, V, Ta)-based flat soft magnetic metal powder including: an Fe—Ni—Mo—(Nb, V, Ta)-based soft magnetic metal powder (hereinafter, referred to as an Fe—Ni—Mo—(Nb, V, Ta)-based flat soft magnetic metal powder); and an oxide film having a thickness in the range of 50 to 1000 Å (5 to 100 nm) which is formed on the surface of the Fe—Ni—Mo—(Nb, V, Ta)-based soft magnetic metal powder, wherein the Fe—Ni—Mo—(Nb, V, Ta)-based soft magnetic metal powder includes a component composition which includes Ni in the range of 60 to 90 mass %, Mo in the range of 0.05 to 10 mass %, one kind or two or more kinds of Nb, V, and Ta in the range of 0.05 to 19.95 mass % in total, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—Mo—(Nb, V, Ta)-based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

Another aspect of the invention provides an oxide-coated Fe—Ni—Mo—(Nb, V, Ta)-based flat soft magnetic metal powder including: an Fe—Ni—Mo—(Nb, V, Ta)-based soft magnetic metal powder (hereinafter, referred to as an Fe—Ni—Mo—(Nb, V, Ta)-based flat soft magnetic metal powder); and an oxide film having a thickness in the range of 50 to 1000 Å (5 to 100 nm) which is formed on the surface of the Fe—Ni—Mo—(Nb, V, Ta)-based soft magnetic metal powder, wherein the Fe—Ni—Mo—(Nb, V, Ta)-based soft magnetic metal powder includes a component composition which includes Ni in the range of 60 to 90 mass %, Mo in the range of 0.05 to 10 mass %, one kind or two or more kinds of Nb, V, and Ta in the range of 0.05 to 19.95 mass % in total, one or two kinds of Al and Mn in the range of 0.01 to 1 mass % in total, and the balance including Fe and inevitable impurities; a size and a shape of an average grain size in the range of 30 to 150 μm and an aspect ratio (average grain size/average thickness) in the range of 5 to 500; and a flat face, wherein when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—Mo—(Nb, V, Ta)-based flat soft magnetic metal powder and an angle formed by the incidence direction and the flat face is equal to an angle formed by the diffraction direction and the flat face, a peak intensity ratio $I_{220}/I_{111}$ is in the range of 0.1 to 10.

Another aspect of the invention provides a composite magnetic material including: a resin; and the oxide-coated Fe—Ni—Mo—(Nb, V, Ta)-based flat soft magnetic metal powder described above which is dispersed in the resin so as to orient the flat face thereof. It is preferable that the flat face of the oxide-coated Fe—Ni—Mo—(Nb, V, Ta)-based flat soft magnetic metal powder be oriented in a direction crossing the thickness direction of a composite magnetic sheet as the composite magnetic material.

Another aspect of the invention provides a composite magnetic sheet including: the composite magnetic material described immediately above, wherein the oxide-coated Fe—Ni—Mo—(Nb, V, Ta)-based flat soft magnetic metal powder is dispersed so as to orient the flat face thereof in a direction perpendicular to a thickness direction of the composite magnetic sheet.

The oxide-coated Fe—Ni—(Nb, V, Ta)-based flat soft magnetic metal powder described above is produced by heating the Fe—Ni—(Nb, V, Ta)-based flat soft magnetic metal powder described above in an oxidizing atmosphere such as an atmosphere of oxygen-containing mixture gas and the atmosphere at a temperature of 200° C. to 600° C. for 1 minute to 24 hours. Alternatively, the oxide-coated Fe—Ni—(Nb, V, Ta)-based flat soft magnetic metal powder is produced by heating the Fe—Ni—(Nb, V, Ta)-based flat soft magnetic metal powder described above in warm water at a temperature of 50° C. to 100° C. for 1 minute to 96 hours and then drying it at a temperature in the range of a room temperature to 200° C.

The oxide-coated Fe—Ni—Mo—(Nb, V, Ta)-based flat soft magnetic metal powder described above is produced by the use of the same method as the method of producing the oxide-coated Fe—Ni—(Nb, V, Ta)-based flat soft magnetic metal powder described above, except that the Fe—Ni—Mo—(Nb, V, Ta)-based flat soft magnetic metal powder described above is used instead of the Fe—Ni—(Nb, V, Ta)-based flat soft magnetic metal powder described above.

The oxide-coated Fe—Ni—(Nb, V, Ta)-based flat soft magnetic metal powder or the oxide-coated Fe—Ni—Mo—(Nb, V, Ta)-based flat soft magnetic metal powder according to the invention has an average grain size in the range of 30 to 150 μm, preferably in the range of 35 to 140 μm and an aspect ratio in the range of 5 to 500.

When the thickness of the oxide film of the oxide-coated Fe—Ni—(Nb, V, Ta)-based flat soft magnetic metal powder described above or the thickness of the oxide film of the oxide-coated Fe—Ni—Mo—(Nb, V, Ta)-based flat soft magnetic metal powder described above is less than 50 Å (5 nm), the resistivity of the composite magnetic sheet is poor, which is not desirable. On the other hand, when the thickness of the oxide film is greater than 1000 Å (100 nm), a coercive force increases and thus a radio wave absorbing characteristic of the composite magnetic sheet is deteriorated, which is not desirable. Accordingly, the lower limit of the thickness of the oxide film is set to 50 Å (5 nm) and the upper limit is set to 1000 Å (100 nm).

Examples of the resin used in the composite magnetic material and the composite magnetic sheet according to the invention include polyethylene chloride, silicone resin, polyurethane, polyvinyl acetate, vinyl ethylene-acetate copolymer, acrylonitril-butadiene-styrene resin (ABS resin), polyvinyl chloride, polyvinyl butyral, thermoplastic elastomer, EPDM copolymer rubber (ethylene/propylene copolymer rubber), styrene-butadiene-based rubber, and acrylonitril-butadiene-based rubber, and blended material thereof or blended and denatured material thereof. A resin having two or more repeating units selected from repeating units constituting any resin described above or a material obtained by additionally denaturing the resin may be used.

The Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention have high permeability and thus can provide a high-frequency magnetic material suitable for an inductor. Due to the high permeability, they can provide a radio wave absorber having an excellent radio wave absorbing characteristic. Accordingly, it is possible to contribute to the fields of electrical and electronic industries.

In the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention, the reasons for defining the component composition, the average grain size, the aspect ratio, and the peak intensity ratio as described above will be described.

(A) Component Composition

Ni:

The reason for defining the content of Ni to the range of 60 to 90 mass % in the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention is that magnetic characteristics are deteriorated when the content of Ni is less than 60 mass % or greater than 90 mass %. The range is a well-known range and the content of Ni in the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—

(Nb, V, Ta)-based flat soft magnetic metal powder according to the invention is more preferably in the range of 70 to 85 mass %.

Mo:

The reason for defining the content of Mo to the range of 0.05 to 10 mass % in the Fe—Ni—Mo—(Nb, V, Ta)-based flat soft magnetic metal powder and the oxide-coated Fe—Ni—Mo—(Nb, V, Ta)-based flat soft magnetic metal powder according to the invention is that the formation of the $FeNi_3$ ordered phase is excessive due to the slow cooling after heating when the content of Mo is less than 0.05 mass %, and the crystal magnetic anisotropy constant $K_1$ is negative with too large an absolute value, thereby reducing the permeability. On the other hand, when the content of Mo is greater than 10 mass %, the formation of the $FeNi_3$ ordered phase is not sufficient, the crystal magnetic anisotropy constant $K_1$ is negative with too small an absolute value or is positive, and an effect of making the flat face be the face of easy magnetization is not sufficient due to the crystal magnetic anisotropy, thereby reducing the permeability in the flat face. The content of Mo in the Fe—Ni—Mo—(Nb, V, Ta)-based flat soft magnetic metal powder and the oxide-coated Fe—Ni—Mo—(Nb, V, Ta)-based flat soft magnetic metal powder is more preferably in the range of 1 to 5 mass %.

Nb, V, Ta:

The reason for defining the content of the components (one kind or two or more kinds of Nb, V, and Ta) in the Fe—Ni—(Nb, V, Ta)-based flat soft magnetic metal powder and the oxide-coated Fe—Ni—(Nb, V, Ta)-based flat soft magnetic metal powder according to the invention to the range of 0.05 to 20 mass % is that the formation of the $FeNi_3$ ordered phase is excessive due to the slow cooling after heating when the content of the components is less than 0.05 mass %, and the crystal magnetic anisotropy constant $K_1$ is negative with too large an absolute value, thereby reducing the permeability. On the other hand, when the content of one kind or two or more kinds of the components (Nb, V, and Ta) is greater than 20 mass %, the formation of the $FeNi_3$ ordered phase is not sufficient, the crystal magnetic anisotropy constant $K_1$ is negative with too small an absolute value or is positive, and an effect of making the flat face be the face of easy magnetization is not sufficient due to the crystal magnetic anisotropy, thereby reducing the permeability in the flat face. The content of the components in the Fe—Ni—(Nb, V, Ta)-based flat soft magnetic metal powder and the oxide-coated Fe—Ni—(Nb, V, Ta)-based flat soft magnetic metal powder is more preferably in the range of 1 to 15 mass %.

The reason for defining the content of the components (one kind or two or more kinds of Nb, V, and Ta) in the Fe—Ni—Mo—(Nb, V, Ta)-based flat soft magnetic metal powder and the oxide-coated Fe—Ni—Mo—(Nb, V, Ta)-based flat soft magnetic metal powder according to the invention to the range of 0.05 to 19.95 mass % is that the formation of the $FeNi_3$ ordered phase is excessive due to the slow cooling after heating when the content of the components is less than 0.05 mass %, and the crystal magnetic anisotropy constant $K_1$ is negative with too large an absolute value, thereby reducing the permeability. On the other hand, when the content of one kind or two or more kinds of the components Nb, V, and Ta is greater than 19.95 mass %, the formation of the $FeNi_3$ ordered phase is not sufficient, the crystal magnetic anisotropy constant $K_1$ is negative with too small an absolute value or is positive, and an effect of making the flat face be the face of easy magnetization is not sufficient due to the crystal magnetic anisotropy, thereby reducing the permeability in the flat face. The content of the components in the Fe—Ni—Mo—(Nb, V, Ta)-based flat soft magnetic metal powder and the oxide-coated Fe—Ni—Mo—(Nb, V, Ta)-based flat soft magnetic metal powder is more preferably in the range of 0.5 to 15 mass %.

Al, Mn:

By adding these components, the Fe—Ni—(Nb, V, Ta)-based flat soft magnetic metal powder or the Fe—Ni—Mo—(Nb, V, Ta)-based flat soft magnetic metal powder is made to have a desulfurizing function and a deoxidizing function. In addition, since the workability thereof is improved to make it easy to produce a flat powder by adding these components, the components are added if necessary. When the content of the components is less than 0.01 mass %, the desired effects cannot be obtained. On the other hand, when the content of the components is greater than 1 mass %, the permeability thereof is reduced. Therefore, the content of the components which are contained in the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention as needed is defined within the range of 0.01 to 1 mass %.

(B) Average Grain Size:

In the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention, when the average grain size is less than 30 μm, the introduction of strain is marked at the time of performing the flattening process and thus the magnetic characteristics are not sufficient even by performing a heating process at a temperature of 500° C. or more. On the other hand, when the average grain size is greater than 150 μm, the powders are bent or broken to pieces when mixing with a resin, etc. at the time of producing a sheet or the like, thereby deteriorating the magnetic characteristics. Accordingly, the average grain size of the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention is defined within the range of 30 to 150 μm. The average grain size is more preferably in the range of 35 to 140 μm.

(C) Aspect Ratio:

In the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention, when the aspect ratio is less than 5, a demagnetizing field of the powders is increased and thus the permeability in the flat face is reduced. On the other hand, when the aspect ratio is greater than 500, the introduction of strain is marked at the time of performing the flattening process and the magnetic characteristics are not sufficient even by performing the heating process at a temperature of 500° C. or more. Accordingly, the aspect ratio of the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention is defined within the range of 5 to 500.

(D) Peak Intensity Ratio:

When the Fe—Ni—(Nb, V, Ta)-based flat soft magnetic metal powder or the Fe—Ni—Mo—(Nb, V, Ta)-based flat soft magnetic metal powder is flattened along with a solvent having a high viscosity by the use of an attritor or a ball mill, the Fe—Ni—(Nb, V, Ta)-based metal crystal system or the Fe—Ni—Mo—(Nb, V, Ta)-based metal crystal system is a face-centered cubic (fcc), the slip plane is a (111) face, and a slip direction is <110>. Accordingly, the (110) face of a face-centered cubic (fcc) lattice is oriented parallel to the flat face of the powder by means of the flattening process. Therefore, in an X-ray diffraction pattern measured in a state where a plane including an incidence direction and a diffraction direction of an X ray is perpendicular to the flat face of the flat soft magnetic metal powder and an angle formed by the incidence direction and the flat face is equal to an angle formed by the diffraction direction and the flat face, the peak intensity of face index (220) is relatively high compared with the peak intensities of other face indexes (111) and (200) of the face-centered cubic (fcc) lattice.

Accordingly, the peak intensity $I_{220}$ of the (220) face is measured as an indicator indicating that the (110) face of the fcc lattice is oriented parallel to the flat face of the powder and the peak intensity ratio $I_{220}/I_{111}$ to the peak intensity $I_{111}$ of face index (111) indicating the maximum peak when the crystal orientation is not oriented is calculated. In the (110) face, since only a small peak is observed due to the formation of the $FeNi_3$ ordered phase by means of an extinction rule of a diffraction peak of the face-centered cubic (fcc) lattice and the peak intensity thereof is affected by the formation amount of the $FeNi_3$ ordered phase, the peak intensity $I_{220}$ of face index (220) not affected by the formation of the $FeNi_3$ ordered phase and being a secondary diffraction peak in the (110) face is noted as an indicator indicating that the (110) face of the fcc lattice is oriented parallel to the flat face of the powder.

In the Fe—Ni—(Nb, V, Ta)-based flat soft magnetic metal powder or the Fe—Ni—Mo—(Nb, V, Ta)-based flat soft magnetic metal powder according to the invention, the reason for defining $I_{220}/I_{111}$ within the range of 0.1 to 10 is that the effect of making the flat face be the face of easy magnetization is not sufficient due to the crystal magnetic anisotropy when the peak intensity ratio is less than 0.1, thereby reducing the permeability in the flat face. On the other hand, when the peak intensity ratio is greater than 10, it is difficult to industrially produce the powder. The peak intensity ratio is preferably in the range of 0.30 to 10 and more preferably in the range of 0.50 to 10.

The viscosity of the solvent having high viscosity, which is used to produce the Fe—Ni—(Nb, V, Ta)-based flat soft magnetic metal powder or the Fe—Ni—Mo—(Nb, V, Ta)-based flat soft magnetic metal powder, is preferably in the range of 2 to 5 mPas (milli pascal second) at 20° C. When the viscosity of the solvent added at the time of performing the flattening process using the attritor or the ball mill is less than 2 mPas, an effect of alleviating an impact acting on the soft magnetic powder as a raw powder is not sufficient and the powder is pulverized at the time of performing the flattening process, thereby not obtaining large sized powders having a small thickness. In addition, the effect of orienting the (110) face parallel to the flat face of the powder is not sufficient, thereby reducing the permeability of the powder. On the other hand, when the viscosity of the solvent is greater than 5 mPas, the efficiency of the flattening process is markedly lowered, a valve of a take-out port is clogged at the time of taking out a slurry having the powder and the solvent mixed with each other after performing the flattening process, or a circulating device for the slurry installed to enhance the uniformity of the flattening process is clogged.

As the solvent having high viscosity, higher alcohols which are in a liquid phase at normal temperature, such as isobutyl alcohol (viscosity at 20° C. is 4.4 mPas (milli pascal second), where 1 mPas=1 cP (centi poise: the same is true in the following description)), isopentyl alcohol (4.4 mPas), 1-butanol (3.0 mPas), 1-propanol (2.2 mPas), and 2-propanol (2.4 mPas), can be used. As a solvent obtained by dissolving the higher alcohol in a liquid or solid phase at normal temperature, ethylene glycol, or glycerin in water, ethanol, or methanol may be used. The solvent obtained by dissolving the higher alcohol in a liquid or solid phase at normal temperature, ethylene glycol, or glycerin in water, ethanol, or methanol exhibits higher viscosity than that of water (1.0 mPas), ethanol (1.2 mPas), or methanol (0.6 mPas) used in the past.

DETAILED DESCRIPTION OF THE INVENTION

EXAMPLE 1

A melt was prepared by melting an alloy material by the use of radio waves, atomized powders were prepared by atomizing the melt using water, and atomized powders having an average grain size of about 30 μm were prepared by classifying the atomized powders. In addition, a solvent (of which the viscosity is 3.1 mPas at 20° C.) in which 35 mass % of glycerin is added to ethanol as a solvent was prepared.

The solvent containing 35 mass % of glycerin in ethanol was added to the atomized powders, a flattening process was performed with an attritor for the times shown in Tables 2 and 3, and the resultant was put into a heat-treating furnace and was subjected to a heat process of leaving the resultant in the atmosphere of nitrogen gas at a temperature of 600° C. for 3 hours and then cooling the resultant at a cooling rate of 100° C./h. The heat-treated powders were classified by the use of an air classifier to produce flat soft magnetic powders according to the invention (hereinafter, referred to as flat soft magnetic metal powder according to the invention or flat-type soft magnetic metal powder according to the invention) 1 to 20 having the component compositions shown in Table 1 and the average grain sizes d, the average thicknesses t, and the aspect ratios (d/t) shown in Tables 2 and 3 and flat soft magnetic metal powders as a comparison example (hereinafter, referred to as comparative flat soft magnetic metal powder or comparative flat-type soft magnetic metal powder) 1 and 2. Coercive forces Hc1 (Oe) of flat soft magnetic metal powders 1 to 20 according to the invention and comparative flat soft magnetic metal powders 1 and 2 were measured and the results thereof are shown in Tables 2 and 3. Plates having a thickness of 1 mm and the component compositions shown in Table 1 were produced out of the melt obtained by melting the alloy material using radio frequency waves, Vickers hardness of the plates was measured, and the results are shown in Tables 2 and 3.

1 Oe is equal to about 80 A/m.

CONVENTIONAL EXAMPLE 1

Ethanol (having viscosity of 1.2 mPas at 20° C.) prepared as a solvent was added to the atomized powders, and the resultant was subjected to a flattening process using an attritor, was put into a heat-treating furnace, and was subjected to a heat process of leaving the resultant in the atmosphere of nitrogen gas at a temperature of 600° C. for 3 hours and then cooling the resultant at a cooling rate of 100° C./h. The heat-treated powders were classified by the use of an air classifier to produce conventional flat soft magnetic powder (hereinafter, referred to as conventional flat soft magnetic metal powder or conventional flat-type soft magnetic metal powder) 1 having the component composition shown in Table 1 and the average grain size d, the average thickness t, and the aspect ratio (d/t) shown in Tables 2 and 3. A coercive force Hc1 (Oe) of conventional flat soft magnetic metal powder 1 was measured and the result thereof is shown in Table 3. Plates having a thickness of 1 mm and the component composition shown in Table 1 were produced out of the melt obtained by melting the alloy material using radio frequency waves, Vickers hardness of the plates was measured, and the result is shown in Table 3.

By mixing 15 mass % of polyethylene chloride with flat soft magnetic metal powders 1 to 20 according to the invention, comparative flat soft magnetic metal powders 1 and 2, and conventional flat soft magnetic metal powder 1, which are all obtained as described above, and shaping the resultants in a roll shape, composite magnetic sheets having a thickness of 0.5 mm in which the flat faces of the flat soft magnetic metal powders are oriented parallel to sheet surfaces (in other words, the flat faces of the flat soft magnetic metal powders are oriented perpendicular to the thickness direction of the composite magnetic sheets) were produced. X-ray diffraction patterns of Cu—Kα were measured in a state where a plane including an incidence direction and a diffraction direction of an X ray is perpendicular to the sheet surface of the respective composite magnetic sheets and an angle formed by the incidence direction and the sheet surface is equal to an angle formed by the diffraction direction and the sheet surface, and the peak intensity ratio $I_{220}/I_{111}$ was calculated, the results of which are shown in Tables 2 and 3.

As can be clearly seen from Tables 2 and 3, in the Fe—Ni—(Nb, V, Ta)-based flat soft magnetic metal powder according to the invention obtained by flattening the Fe—Ni—(Nb, V, Ta)-based soft magnetic metal powder along with a solvent having high viscosity by the use of an attritor, the (100) face of the face-centered cubic (fcc) lattice is oriented parallel to the flat face of the powder, but the peak of face index (110) hardly appeared in the X-ray diffraction pattern due to the extinction rule of a diffraction peak of the fcc lattice and only a slight peak was observed due to the formation of the $FeNi_3$ ordered phase. The peak intensity is affected by the formation amount of the $FeNi_3$ ordered phase. Accordingly, the peak intensity $I_{220}$ of face index (220) was measured which is a secondary diffraction peak in the (110) face and which is not affected by the formation of the $FeNi_3$ ordered phase to calculate the peak intensity ratio $I_{220}/I_{111}$ to the peak intensity $I_{11}$ of face index (111) indicating the maximum peak when the crystal orientation is not oriented.

Samples were prepared by cutting out the composite magnetic sheets into a ring shape with an outer diameter of 20 mm and an inner diameter of 10 mm and the permeability μ of the samples was measured, the results of which are shown in Tables 2 and 3.

Samples were prepared by cutting out the composite magnetic sheets into a narrow strip shape with a length of 20 mm and a width of 10 mm, the coercive forces Hc2 (Oe) of the samples were measured, and the sections thereof were observed with a metal microscope to check whether the flat soft magnetic metal powders were strained in an S shape and were dispersed in the substrates of the samples, the results of which are shown in Tables 2 and 3.

TABLE 1

| Flat-type soft magnetic metal powder | | Component composition (mass %) | | | | | | |
|---|---|---|---|---|---|---|---|---|
| | | Ni | Nb | V | Ta | Al | Mn | Fe |
| The invention | 1 | 78.7 | 8.6 | — | — | — | — | balance |
| | 2 | 78.3 | 8.9 | — | — | — | — | balance |
| | 3 | 78.1 | 8.5 | — | — | 0.3 | — | balance |
| | 4 | 83.1 | — | 3.8 | — | — | — | balance |
| | 5 | 83.5 | — | 5.4 | — | — | — | balance |
| | 6 | 83.3 | — | 7.1 | — | — | 0.2 | balance |
| | 7 | 81.5 | — | — | 4.3 | — | — | balance |
| | 8 | 82.0 | — | — | 4.9 | — | — | balance |
| | 9 | 82.4 | — | — | 4.0 | 0.3 | 0.2 | balance |
| | 10 | 79.8 | 7.5 | 3.4 | — | — | — | balance |
| | 11 | 80.1 | 5.1 | 5.4 | — | — | — | balance |
| | 12 | 78.5 | 5.2 | — | 3.1 | — | — | balance |
| | 13 | 80.5 | 8.3 | — | 5.4 | — | — | balance |
| | 14 | 80.1 | — | 6.1 | 2.8 | — | — | balance |
| | 15 | 77.5 | — | 5.4 | 3.6 | — | — | balance |
| | 16 | 78.1 | 8.5 | — | — | — | 0.2 | balance |
| | 17 | 83.1 | — | 3.8 | — | 0.3 | — | balance |
| | 18 | 81.1 | — | — | 4.6 | 0.3 | — | balance |
| | 19 | 82.5 | — | — | 4.1 | — | 0.2 | balance |
| | 20 | 78.7 | 8.6 | — | — | 0.3 | 0.2 | balance |
| Comparative Example | 1 | 68.3 | 20.5* | — | — | — | — | balance |
| | 2 | 72.9 | — | 20.5* | — | — | — | balance |
| Conventional Example 1 | | 68.2 | 2 | 1 | — | — | — | balance |

(Mark * means a value departing from the scope of the invention.)

TABLE 2

| Flat-type soft magnetic metal powder | | Flattening time (h) | Characteristics of flat soft magnetic metal powder: average grain size d (μm) | average thickness t (μm) | aspect ratio d/t | $I_{220}/I_{111}$ | coercive force Hc1 (Oe) | Vickers hardness | Characteristics of composite magnetic sheet: permeability μ | coersive force Hc2 (Oe) | Existence of powder strained in an S shape |
|---|---|---|---|---|---|---|---|---|---|---|---|
| The invention | 1 | 18 | 110 | 1.8 | 61.1 | 1.2 | 2.8 | 245 | 73 | 3.0 | none |
| | 2 | 22 | 113 | 1.8 | 62.7 | 1.3 | 2.8 | 251 | 72 | 2.9 | none |
| | 3 | 12 | 124 | 1.6 | 77.5 | 1.4 | 2.2 | 249 | 79 | 2.4 | none |
| | 4 | 10 | 103 | 1.9 | 54.2 | 1.1 | 2.9 | 188 | 65 | 2.9 | none |
| | 5 | 12 | 101 | 1.9 | 53.2 | 1.0 | 3.0 | 208 | 68 | 3.1 | none |
| | 6 | 10 | 120 | 1.6 | 75.0 | 1.3 | 2.4 | 199 | 76 | 2.6 | none |
| | 7 | 14 | 93 | 2.0 | 46.5 | 0.8 | 3.2 | 200 | 61 | 3.3 | none |
| | 8 | 14 | 95 | 1.9 | 50.0 | 0.9 | 3.1 | 205 | 62 | 3.2 | none |
| | 9 | 10 | 118 | 1.7 | 69.4 | 1.1 | 2.3 | 203 | 70 | 2.5 | none |
| | 10 | 18 | 102 | 2.1 | 48.6 | 1.1 | 2.8 | 291 | 72 | 2.9 | none |
| | 11 | 20 | 105 | 2.0 | 52.5 | 1.1 | 2.8 | 271 | 73 | 3.0 | none |
| | 12 | 22 | 110 | 1.8 | 61.1 | 1.2 | 3.0 | 290 | 75 | 3.2 | none |
| | 13 | 24 | 108 | 1.8 | 60.0 | 1.2 | 3.1 | 305 | 76 | 3.2 | none |

TABLE 2-continued

| Flat-type soft magnetic metal powder | Flattening time (h) | Characteristics of flat soft magnetic metal powder: average grain size d (μm) | average thickness t (μm) | aspect ratio d/t | $I_{220}/I_{111}$ | coercive force Hc1 (Oe) | Vickers hardness | Characteristics of composite magnetic sheet: permeability μ | coersive force Hc2 (Oe) | Existence of powder strained in an S shape |
|---|---|---|---|---|---|---|---|---|---|---|
| 14 | 22 | 104 | 1.9 | 54.7 | 1.1 | 2.9 | 241 | 68 | 3.0 | none |
| 15 | 22 | 102 | 1.9 | 53.7 | 1.0 | 3.0 | 210 | 69 | 3.1 | none |

TABLE 3

| Flat-type soft magnetic metal powder | | Flattening time (h) | Characteristics of flat soft magnetic metal powder: average grain size d (μm) | average thickness t (μm) | aspect ratio d/t | $I_{220}/I_{111}$ | coercive force Hc1 (Oe) | Vickers hardness | Characteristics of composite magnetic sheet: permeability μ | coercive force Hc2 (Oe) | Existence of powder strained in an S shape |
|---|---|---|---|---|---|---|---|---|---|---|---|
| The invention | 16 | 20 | 124 | 1.6 | 77.5 | 1.2 | 2.2 | 253 | 81 | 2.4 | none |
| | 17 | 10 | 113 | 1.8 | 62.8 | 1.2 | 2.3 | 193 | 77 | 2.4 | none |
| | 18 | 10 | 118 | 1.7 | 69.4 | 1.1 | 2.1 | 195 | 72 | 2.2 | none |
| | 19 | 10 | 118 | 1.7 | 69.4 | 1.2 | 2.2 | 192 | 74 | 2.4 | none |
| | 20 | 12 | 121 | 1.6 | 75.6 | 1.1 | 2.3 | 231 | 76 | 2.4 | none |
| Comparative Example | 1 | 36 | 105 | 1.8 | 58.3 | 0.81 | 3.9 | 305 | 51 | 4.1 | none |
| | 2 | 24 | 101 | 1.8 | 56.1 | 0.95 | 3.7 | 251 | 49 | 4.0 | none |
| Conventional Example 1 | | 8 | 91 | 2.0 | 45.5 | 0.51 | 2.9 | 168 | 42 | 3.3 | none |

It can be seen from the results shown in Tables 1 to 3 that flat soft magnetic metal powders 1 to 20 according to the invention have coercive forces equal to or less than and permeability higher than those of conventional flat soft magnetic metal powder 1. Accordingly, the composite magnetic sheets formed of flat soft magnetic metal powders 1 to 20 according to the invention have excellent characteristics as a radio wave absorber or a high-frequency magnetic material, compared with the composite magnetic sheet formed of conventional flat soft magnetic metal powder 1. However, it can be seen that the composite magnetic sheet formed of comparative flat soft magnetic metal powders 1 and 2 with conditions other than the conditions of the invention exhibit undesirable characteristics.

EXAMPLE 2

By using flat soft magnetic metal powders 1 to 20 according to the invention shown in Tables 1 to 3 and produced in Example 1 as a raw material and oxidizing the powders with the conditions shown in Tables 4 and 5, oxide films having thicknesses shown in Tables 4 and 5 were formed on the surfaces of the flat soft magnetic metal powders according to the invention, thereby producing oxide-coated flat soft magnetic metal powders according to the invention (hereinafter, referred to as oxide-coated flat soft magnetic metal powders according to the invention) 1 to 20.

By mixing 15 mass % of polyethylene chloride with oxide-coated flat soft magnetic metal powders 1 to 20 according to the invention and shaping the resultants in a roll shape, composite magnetic sheets having a thickness of 0.5 mm in which the flat faces of the oxide-coated flat soft magnetic metal powders are oriented parallel to sheet surfaces (in other words, the flat faces of the oxide-coated flat soft magnetic metal powders are oriented perpendicular to the thickness direction of the composite magnetic sheets) were produced and the resistivity (Ω·cm) of the composite magnetic sheets was measured, the results of which are shown in Tables 4 and 5. The other characteristics of oxide-coated flat soft magnetic metal powders 1 to 20 according to the invention were almost equal to those of flat soft magnetic metal powders 1 to 20 according to the invention in Example 1.

TABLE 4

| Oxide-coated soft magnetic metal powder | | Raw material | Oxide forming condition: atmosphere | heating temperature (° C.) | heating time (hour) | Thickness of oxide film (Å) | Resistivity of composite magnetic sheet (Ω · cm) |
|---|---|---|---|---|---|---|---|
| The invention | 1 | Flat soft magnetic metal powder 1 in Example 1 | air | 400 | 1 | 1000 | $10^7$ |
| | 2 | Flat soft magnetic metal powder 2 in Example 1 | air | 375 | 2 | 500 | $10^7$ |
| | 3 | Flat soft magnetic metal powder 3 in Example 1 | air | 350 | 3 | 700 | $10^7$ |
| | 4 | Flat soft magnetic metal powder 4 in Example 1 | air | 325 | 6 | 800 | $10^7$ |

TABLE 4-continued

| Oxide-coated soft magnetic metal powder | Raw material | Oxide forming condition: atmosphere | heating temperature (° C.) | heating time (hour) | Thickness of oxide film (Å) | Resistivity of composite magnetic sheet (Ω · cm) |
|---|---|---|---|---|---|---|
| 5 | Flat soft magnetic metal powder 5 in Example 1 | air | 300 | 10 | 500 | $10^7$ |
| 6 | Flat soft magnetic metal powder 6 in Example 1 | $O_2$: 10% $N_2$: 90% | 400 | 1 | 600 | $10^6$ |
| 7 | Flat soft magnetic metal powder 7 in Example 1 | $O_2$: 10% $N_2$: 90% | 375 | 2 | 300 | $10^6$ |
| 8 | Flat soft magnetic metal powder 8 in Example 1 | $O_2$: 10% $N_2$: 90% | 350 | 3 | 400 | $10^6$ |
| 9 | Flat soft magnetic metal powder 9 in Example 1 | $O_2$: 10% $N_2$: 90% | 325 | 6 | 450 | $10^6$ |
| 10 | Flat soft magnetic metal powder 10 in Example 1 | $O_2$: 10% $N_2$: 90% | 300 | 10 | 300 | $10^6$ |

TABLE 5

| | Oxide-coated soft magnetic metal powder | Raw material | oxide film forming condition: atmosphere | heating temperature (° C.) | heating time (hour) | Thickness of oxide film (Å) | Resistivity of composite magnetic sheet (Ω · cm) |
|---|---|---|---|---|---|---|---|
| The invention | 11 | Flat soft magnetic metal powder 11 in Example 1 | distilled water | 100 | 3 | 100 | $10^7$ |
| | 12 | Flat soft magnetic metal powder 12 in Example 1 | distilled water | 100 | 1.5 | 80 | $10^7$ |
| | 13 | Flat soft magnetic metal powder 13 in Example 1 | distilled water | 100 | 1 | 60 | $10^7$ |
| | 14 | Flat soft magnetic metal powder 14 in Example 1 | distilled water | 100 | 0.3 | 55 | $10^4$ |
| | 15 | Flat soft magnetic metal powder 15 in Example 1 | distilled water | 100 | 0.2 | 50 | $10^3$ |
| | 16 | Flat soft magnetic metal powder 16 in Example 1 | distilled water | 90 | 1.5 | 60 | $10^6$ |
| | 17 | Flat soft magnetic metal powder 17 in Example 1 | distilled water | 80 | 3 | 60 | $10^6$ |
| | 18 | Flat soft magnetic metal powder 18 in Example 1 | distilled water | 70 | 8 | 60 | $10^6$ |
| | 19 | Flat soft magnetic metal powder 19 in Example 1 | distilled water | 60 | 28 | 60 | $10^6$ |
| | 20 | Flat soft magnetic metal powder 20 in Example 1 | distilled water | 50 | 100 | 60 | $10^6$ |

It can be seen from the results shown in Tables 4 and 5 that the composite magnetic sheets formed of oxide-coated flat soft magnetic metal powders 1 to 20 obtained by heating flat soft magnetic metal powders 1 to 20 according to the invention in Example 1 in an oxidizing atmosphere or in distilled water to form a thick oxide film on the surfaces thereof exhibit high resistivity.

EXAMPLE 3

A melt was prepared by melting an alloy material by the use of radio waves, atomized powders were prepared by atomizing the melt using water, and atomized powders having an average grain size of about 30 μm were prepared by classifying the atomized powders. In addition, a solvent (having viscosity of 3.1 mPas at 20° C.) in which 35 mass % of glycerin is added to ethanol as a solvent was prepared.

The solvent containing 35 mass % of glycerin in ethanol was added to the atomized powders, a flattening process was performed with an attritor for the times shown in Tables 7 and 8, and the resultant was put into a heat-treating furnace and was subjected to a heat process of leaving the resultant in the atmosphere of nitrogen gas at a temperature of 600° C. for 3 hours and then cooling the resultant at a cooling speed of 100° C./h. The heat-treated powders were classified by the use of an air classifier to produce flat soft magnetic powders according to the invention (hereinafter, referred to as flat soft magnetic metal powder according to the invention or flat-type soft magnetic metal powder according to the invention) 21 to 40 having the component compositions shown in Table 6 and the average grain sizes d, the average thicknesses t, and the aspect ratios (d/t) shown in Tables 7 and 8 and flat soft magnetic metal powders as a comparison example (hereinafter, referred to as comparative flat soft magnetic metal powder or comparative flat-type soft magnetic metal powder) 3 to 8. Coercive forces Hc1 (Oe) of flat soft magnetic metal powders 21 to 40 according to the invention and comparative flat soft magnetic metal powders 3 to 8 were measured and the results thereof are shown in Tables 7 and 8. Plates having a thickness of 1 mm and the component compositions shown in Table 6 were produced out of the melt obtained by melting the alloy material using radio frequency waves, Vickers hardness of the plates was measured, and the results are shown in Tables 7 and 8. 1 Oe is equal to about 80 A/m.

CONVENTIONAL EXAMPLE 2

Ethanol (having viscosity of 1.2 mPas at 20° C.) prepared as a solvent was added to the atomized powders, and the resultant was subjected to a flattening process using an attritor, was put into a heat-treating furnace, and was subjected to a heat process of leaving the resultant in the atmosphere of nitrogen gas at a temperature of 600° C. for 3 hours and then cooling the resultant at a cooling rate of 100° C./h. The heat-treated powders were classified by the use of an air classifier to produce conventional flat soft magnetic powder (hereinafter, referred to as conventional flat soft magnetic metal powder or conventional flat-type soft magnetic metal powder) 2 having the component composition shown in Table 6 and the average grain size d, the average thickness t, and the aspect ratio (d/t) shown in Tables 7 and 8. A coercive force Hc1 (Oe) of conventional flat soft magnetic metal powder 2 was measured and the result thereof is shown in Table 8. Plates having a thickness of 1 mm and the component composition shown in Table 6 were produced out of the melt obtained by melting the alloy material using radio frequency waves, Vickers hardness of the plates was measured, and the results are shown in Table 8.

By mixing 15 mass % of polyethylene chloride with flat soft magnetic metal powders 21 to 40 according to the invention, comparative flat soft magnetic metal powders 3 to 8, and conventional flat soft magnetic metal powder 2, which are all obtained as described above, and shaping the resultants in a roll shape, composite magnetic sheets having a thickness of 0.5 mm in which the flat faces of the flat soft magnetic metal powders are oriented parallel to sheet surfaces (in other words, the flat faces of the flat soft magnetic metal powders are oriented perpendicular to the thickness direction of the composite magnetic sheets) were produced. X-ray diffraction patterns of Cu—Kα were measured in a state where a plane including an incidence direction and a diffraction direction of an X ray is perpendicular to the sheet surface of the respective composite magnetic sheets and an angle formed by the incidence direction and the sheet surface is equal to an angle formed by the diffraction direction and the sheet surface, and the peak intensity ratio $I_{220}/I_{111}$ was calculated, the results of which are shown in Tables 7 and 8.

As can be clearly seen from Tables 7 and 8, in the Fe—Ni—Mo—(Nb, V, Ta)-based flat soft magnetic metal powder according to the invention obtained by flattening the Fe—Ni—Mo—(Nb, V, Ta)-based soft magnetic metal powder along with a solvent having high viscosity by the use of an attritor, the (100) face of the face-centered cubic (fcc) lattice is oriented parallel to the flat face of the powder, but the peak of face index (110) hardly appeared in the X-ray diffraction pattern due to the extinction rule of a diffraction peak of the fcc lattice and only a slight peak was observed due to the formation of the $FeNi_3$ ordered phase. The peak intensity is affected by the formation amount of the $FeNi_3$ ordered phase. Accordingly, the peak intensity $I_{220}$ of face index (220) was measured which is a secondary diffraction peak in the (110) face and which is not affected by the formation of the $FeNi_3$ ordered phase to calculate the peak intensity ratio $I_{220}/I_{111}$ to the peak intensity $I_{111}$ of face index (111) indicating the maximum peak when the crystal orientation is not oriented.

Samples were prepared by cutting out the composite magnetic sheets into a ring shape with an outer diameter of 20 mm and an inner diameter of 10 mm and the permeability μ of the samples was measured, the results of which are shown in Tables 7 and 8.

Samples were prepared by cutting out the composite magnetic sheets into a narrow strip shape with a length of 20 mm and a width of 10 mm, the coercive forces Hc2 (Oe) of the samples were measured, and the sections thereof were observed with a metal microscope to check whether the flat soft magnetic metal powders were strained in an S shape and were dispersed in the substrates of the samples, the results of which are shown in Tables 7 and 8.

TABLE 6

| Flat-type soft magnetic metal powder | | Component composition (mass %) | | | | | | | |
|---|---|---|---|---|---|---|---|---|---|
| | | Ni | Mo | Nb | V | Ta | Al | Mn | Fe |
| The invention | 21 | 78.7 | 0.5 | 8.6 | — | — | — | — | balance |
| | 22 | 78.3 | 1.0 | 8.9 | — | — | — | — | balance |
| | 23 | 78.1 | 3.0 | 8.5 | — | — | — | — | balance |
| | 24 | 83.1 | 0.5 | — | 3.8 | — | — | — | balance |
| | 25 | 83.5 | 1.2 | — | 5.4 | — | — | — | balance |
| | 26 | 83.3 | 2.8 | — | 7.1 | — | — | — | balance |
| | 27 | 81.5 | 0.6 | — | — | 4.3 | — | — | balance |
| | 28 | 82.0 | 1.0 | — | — | 4.9 | — | — | balance |
| | 29 | 82.4 | 3.2 | — | — | 4.0 | — | — | balance |
| | 30 | 79.8 | 2.1 | 7.5 | 3.4 | — | — | — | balance |
| | 31 | 78.5 | 1.0 | 5.2 | — | 3.1 | — | — | balance |
| | 32 | 80.1 | 0.9 | — | 6.1 | 2.8 | — | — | balance |
| | 33 | 80.5 | 1.2 | 4.1 | 2.4 | 2.9 | — | — | balance |
| | 34 | 82.0 | 1.4 | 5.0 | 1.1 | 3.2 | — | — | balance |
| | 35 | 78.1 | 0.9 | 3.8 | 2.3 | 4.0 | — | — | balance |
| | 36 | 78.3 | 1.0 | 8.9 | — | — | — | 0.2 | balance |
| | 37 | 83.1 | 1.2 | — | 5.4 | — | — | 0.2 | balance |
| | 38 | 81.2 | 1.4 | 8.9 | — | — | 0.5 | — | balance |
| | 39 | 79.9 | 1.2 | 5.2 | — | 3.1 | 0.4 | — | balance |
| | 40 | 81.2 | 1.7 | 8.9 | — | — | 0.3 | 0.5 | balance |
| Comparative Example | 3 | 78.7 | 1.0 | 0.04* | — | — | — | — | balance |
| | 4 | 68.3 | 1.0 | 20.5* | — | — | — | — | balance |
| | 5 | 82.5 | 1.0 | — | 0.04* | — | — | — | balance |
| | 6 | 72.9 | 1.0 | — | 20.5* | — | — | — | balance |
| | 7 | 81.8 | 1.0 | — | — | 0.04* | — | — | balance |
| | 8 | 82.1 | 1.0 | — | — | 20.5* | — | — | balance |
| Conventional Example 2 | | 80.2 | 5.0 | —* | — | — | — | — | balance |

(Mark * means a value departing from the scope of the invention.)

TABLE 7

| Flat-type soft magnetic metal powder | | Flattening time (h) | Characteristics of flat soft magnetic metal powder: average grain size d (μm) | average thickness t (μm) | aspect ratio d/t | $I_{220}/I_{111}$ | coercive force Hc1 (Oe) | Casted alloy Vickers hardness | Characteristics of composite magnetic sheet: permeability μ | coercive force Hc2 (Oe) | Existence of powder strained in an S shape |
|---|---|---|---|---|---|---|---|---|---|---|---|
| The invention | 21 | 20 | 108 | 1.8 | 60.0 | 1.1 | 2.9 | 252 | 72 | 3.1 | none |
| | 22 | 24 | 111 | 1.8 | 61.7 | 1.3 | 2.8 | 278 | 74 | 3.0 | none |
| | 23 | 36 | 110 | 1.7 | 64.7 | 1.0 | 2.9 | 291 | 73 | 3.0 | none |

TABLE 7-continued

| Flat-type soft magnetic metal powder | Flattening time (h) | Characteristics of flat soft magnetic metal powder: average grain size d (μm) | average thickness t (μm) | aspect ratio d/t | $I_{220}/I_{111}$ | coercive force Hc1 (Oe) | Casted alloy Vickers hardness | Characteristics of composite magnetic sheet: permeability μ | coercive force Hc2 (Oe) | Existence of powder strained in an S shape |
|---|---|---|---|---|---|---|---|---|---|---|
| 24 | 8 | 100 | 1.9 | 52.6 | 1.1 | 3.0 | 192 | 66 | 3.3 | none |
| 25 | 10 | 102 | 1.9 | 53.7 | 1.2 | 3.1 | 202 | 67 | 3.2 | none |
| 26 | 12 | 96 | 2.0 | 48.0 | 0.9 | 3.0 | 210 | 65 | 3.1 | none |
| 27 | 14 | 92 | 2.1 | 43.8 | 0.8 | 3.3 | 198 | 60 | 3.3 | none |
| 28 | 16 | 91 | 2.0 | 45.5 | 1.2 | 3.1 | 213 | 61 | 3.2 | none |
| 29 | 20 | 90 | 2.2 | 40.9 | 1.0 | 3.2 | 221 | 63 | 3.3 | none |
| 30 | 18 | 102 | 2.0 | 51.0 | 1.1 | 2.9 | 298 | 71 | 3.0 | none |
| 31 | 20 | 108 | 1.8 | 60.6 | 1.1 | 3.0 | 251 | 79 | 3.2 | none |
| 32 | 22 | 105 | 1.9 | 55.3 | 1.2 | 2.9 | 221 | 69 | 3.1 | none |
| 33 | 24 | 109 | 2.0 | 54.5 | 1.3 | 3.0 | 284 | 68 | 3.2 | none |
| 34 | 24 | 110 | 1.9 | 57.9 | 1.1 | 3.2 | 291 | 70 | 3.3 | none |
| 35 | 24 | 102 | 2.1 | 48.6 | 0.9 | 3.1 | 270 | 66 | 3.2 | none |

TABLE 8

| Flat-type soft magnetic metal powder | | Flattening time (h) | Characteristics of flat soft magnetic metal powder: average grain size d (μm) | average thickness t (μm) | aspect ratio d/t | $I_{220}/I_{111}$ | coercive force Hc1 (Oe) | Vickers hardness | Characteristics of composite magnetic sheet: permeability μ | coersive force Hc2 (Oe) | Existence of powder strained in an S shape |
|---|---|---|---|---|---|---|---|---|---|---|---|
| The invention | 36 | 16 | 124 | 1.6 | 77.5 | 1.1 | 2.3 | 248 | 82 | 2.6 | none |
| | 37 | 6 | 112 | 1.8 | 62.2 | 1.0 | 2.3 | 219 | 76 | 2.4 | none |
| | 38 | 24 | 120 | 1.6 | 75.0 | 1.2 | 2.3 | 291 | 84 | 2.5 | none |
| | 39 | 24 | 122 | 1.6 | 76.3 | 1.3 | 2.2 | 265 | 80 | 2.3 | none |
| | 40 | 24 | 120 | 1.7 | 70.6 | 1.1 | 2.4 | 201 | 74 | 2.5 | none |
| Comparative Example | 3 | 10 | 90 | 2.1 | 42.9 | 0.41 | 2.8 | 153 | 41 | 3.0 | existence |
| | 4 | 24 | 105 | 1.9 | 55.3 | 0.78 | 3.5 | 351 | 48 | 3.9 | none |
| | 5 | 10 | 88 | 2.2 | 43.1 | 0.41 | 2.9 | 151 | 39 | 3.2 | existence |
| | 6 | 24 | 100 | 1.8 | 55.6 | 0.81 | 3.9 | 251 | 46 | 4.1 | none |
| | 7 | 10 | 86 | 2.2 | 39.1 | 0.41 | 2.6 | 155 | 36 | 2.9 | existence |
| | 8 | 24 | 98 | 1.9 | 51.6 | 0.95 | 3.8 | 232 | 44 | 4.0 | none |
| Conventional Example 2 | | 7 | 92 | 2 | 46 | 0.41 | 2.8 | 153 | 45 | 3.5 | existence |

(Mark * means a value departing from the scope of the invention.)

It can be seen from the results shown in Tables 6 to 8 that flat soft magnetic metal powders 21 to 40 according to the invention have coercive forces equal to or less than and permeability higher than those of conventional flat soft magnetic metal powder 2 and powders which are strained in an S shape and dispersed do not appear when they are made into sheets. Accordingly, the composite magnetic sheets formed of flat soft magnetic metal powders 21 to 40 according to the invention have excellent characteristics as a radio wave absorber or a high-frequency magnetic material, compared with the composite magnetic sheet formed of conventional flat soft magnetic metal powder 2. However, it can be seen that the composite magnetic sheet formed of comparative flat soft magnetic metal powders 3 to 8 with conditions other than the conditions of the invention exhibit undesirable characteristics.

EXAMPLE 4

By using flat soft magnetic metal powders 21 to 40 according to the invention shown in Tables 6 to 8 and produced in Example 3 as a raw material and oxidizing the powders with the conditions shown in Tables 9 and 10, oxide films having thicknesses shown in Table 9 and 10 were formed on the surfaces of the flat soft magnetic metal powders according to the invention, thereby producing oxide-coated flat soft magnetic metal powders according to the invention (hereinafter, referred to as oxide-coated flat soft magnetic metal powders according to the invention) 21 to 40.

By mixing 15 mass % of polyethylene chloride with oxide-coated flat soft magnetic metal powders 21 to 40 according to the invention and shaping the resultants in a roll shape, composite magnetic sheets having a thickness of 0.5 mm in which the flat faces of the oxide-coated flat soft magnetic metal powders are oriented parallel to sheet surfaces (in other words, the flat faces of the oxide-coated flat soft magnetic metal powders are oriented perpendicular to the thickness direction of the composite magnetic sheets) were produced and the resistivity (Ω·cm) of the composite magnetic sheets was measured, the results of which are shown in Tables 9 and 10. The other characteristics of oxide-coated flat soft magnetic metal powders 21 to 40 according to the invention were almost equal to those of flat soft magnetic metal powders 21 to 40 according to the invention in Example 3.

TABLE 9

| Oxide-coated flat soft magnetic metal powder | | Raw material | Oxide forming condition: atmosphere | heating temperature (° C.) | heating time (hour) | Thickness of oxide film (Å) | Resistivity of composite magnetic sheet (Ω · cm) |
|---|---|---|---|---|---|---|---|
| The invention | 21 | Flat soft magnetic metal powder 21 in Example 3 | air | 400 | 1 | 1000 | $10^7$ |
| | 22 | Flat soft magnetic metal powder 22 in Example 3 | air | 375 | 2 | 500 | $10^7$ |
| | 23 | Flat soft magnetic metal powder 23 in Example 3 | air | 350 | 3 | 700 | $10^7$ |
| | 24 | Flat soft magnetic metal powder 24 in Example 3 | air | 325 | 6 | 800 | $10^7$ |
| | 25 | Flat soft magnetic metal powder 25 in Example 3 | air | 300 | 10 | 500 | $10^7$ |
| | 26 | Flat soft magnetic metal powder 26 in Example 3 | $O_2$: 10% $N_2$: 90% | 400 | 1 | 600 | $10^6$ |
| | 27 | Flat soft magnetic metal powder 27 in Example 3 | $O_2$: 10% $N_2$: 90% | 375 | 2 | 300 | $10^6$ |
| | 28 | Flat soft magnetic metal powder 28 in Example 3 | $O_2$: 10% $N_2$: 90% | 350 | 3 | 400 | $10^6$ |
| | 29 | Flat soft magnetic metal powder 29 in Example 3 | $O_2$: 10% $N_2$: 90% | 325 | 6 | 450 | $10^6$ |
| | 30 | Flat soft magnetic metal powder 30 in Example 3 | $O_2$: 10% $N_2$: 90% | 300 | 10 | 300 | $10^6$ |

TABLE 10

| Oxide-coated flat soft magnetic metal powder | | Raw material | Oxide forming condition: atmosphere | heating temperature (° C.) | heating time (hour) | Thickness of oxide film (Å) | Resistivity of composite magnetic sheet (Ω · cm) |
|---|---|---|---|---|---|---|---|
| The invention | 31 | Flat soft magnetic metal powder 31 in Example 3 | distilled water | 100 | 3 | 100 | $10^7$ |
| | 32 | Flat soft magnetic metal powder 32 in Example 3 | distilled water | 100 | 1.5 | 80 | $10^7$ |
| | 33 | Flat soft magnetic metal powder 33 in Example 3 | distilled water | 100 | 1 | 60 | $10^7$ |
| | 34 | Flat soft magnetic metal powder 34 in Example 3 | distilled water | 100 | 0.3 | 55 | $10^4$ |
| | 35 | Flat soft magnetic metal powder 35 in Example 3 | distilled water | 100 | 0.2 | 50 | $10^3$ |
| | 36 | Flat soft magnetic metal powder 36 in Example 3 | distilled water | 90 | 1.5 | 60 | $10^6$ |
| | 37 | Flat soft magnetic metal powder 37 in Example 3 | distilled water | 80 | 3 | 60 | $10^6$ |
| | 38 | Flat soft magnetic metal powder 38 in Example 3 | distilled water | 70 | 8 | 60 | $10^6$ |
| | 39 | Flat soft magnetic metal powder 39 in Example 3 | distilled water | 60 | 28 | 60 | $10^6$ |
| | 40 | Flat soft magnetic metal powder 40 in Example 3 | distilled water | 50 | 100 | 60 | $10^6$ |

It can be seen from the results shown in Tables 9 and 10 that the composite magnetic sheets formed of oxide-coated flat soft magnetic metal powders 21 to 40 obtained by heating flat soft magnetic metal powders 21 to 40 according to the invention in Example 3 in an oxidizing atmosphere or in distilled water to form a thick oxide film on the surfaces thereof exhibit high resistivity.

Since the Fe—Ni—(Nb, V, Ta)-based flat soft magnetic metal powder, the oxide-coated Fe—Ni—(Nb, V, Ta)-based flat soft magnetic metal powder, the Fe—Ni—Mo—(Nb, V, Ta)-based flat soft magnetic metal powder, and the oxide-coated Fe—Ni—Mo—(Nb, V, Ta)-based flat soft magnetic metal powder according to the invention have high permeability, it is possible to provide a high-frequency magnetic material which is excellent for an antenna and an inductor. In addition, it is possible to provide a radio wave absorber having an excellent radio wave absorbing characteristic due to the high permeability. Accordingly, it is possible to greatly contribute to advancement of electrical and electronic industries.

The invention claimed is:

1. An Fe—Ni—(Nb, V, Ta)-based soft magnetic metal powder (hereinafter, referred to as an Fe—Ni—(Nb, V, Ta)-based flat soft magnetic metal powder), comprising:

a component composition which includes Ni in the range of 60 to 90 mass %, at least one of Nb, V, and Ta in the range of 5.4 to 20 mass % in total, and the balance including Fe and inevitable impurities;

an average grain size in the range of 30 to 150 μm;

an aspect ratio (average grain size/average thickness) in the range of 5 to 500; and a flat face, wherein a peak intensity ratio $I_{220}/I_{111}$ of the Fe—Ni—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the Fe—Ni—(Nb, V, Ta)-based flat soft magnetic metal powder, and an angle formed by the incidence direction and the flat face is equal to an angle formed by the diffraction direction and the flat face.

2. An Fe—Ni—(Nb, V, Ta)-based soft magnetic metal powder (hereinafter, referred to as an Fe—Ni—(Nb, V, Ta)-based flat soft magnetic metal powder), comprising:

a component composition which includes Ni in the range of 60 to 90 mass %, at least one of Nb, V, and Ta in the range of 5.4 to 20 mass % in total, at least one of Al and Mn in the range of 0.01 to 1 mass % in total, and the balance including Fe and inevitable impurities;

an average grain size in the range of 30 to 150 μm;

an aspect ratio (average grain size/average thickness) in the range of 5 to 500; and a flat face, wherein a peak intensity ratio $I_{220}/I_{111}$ of the Fe—Ni—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the Fe—Ni—(Nb, V, Ta)-based flat soft magnetic metal powder, and an angle formed by the incidence direction and the flat face is equal to an angle formed by the diffraction direction and the flat face.

3. A composite magnetic material, comprising:

a resin; and the Fe—Ni—(Nb, V, Ta)-based flat soft magnetic metal powder according to claim 1, which is dispersed in the resin so as to orient the flat face thereof.

4. A composite magnetic material, comprising:

a resin; and the Fe—Ni—(Nb, V, Ta)-based flat soft magnetic metal powder according to claim 2, which is dispersed in the resin so as to orient the flat face thereof.

5. A composite magnetic sheet, comprising:

the composite magnetic material according to claim 3, wherein the Fe—Ni—(Nb, V, Ta)-based flat soft magnetic metal powder is dispersed so as to orient the flat face thereof in a direction perpendicular to a thickness direction of the composite magnetic sheet.

6. A composite magnetic sheet, comprising:

the composite magnetic material according to claim 4, wherein the Fe—Ni—(Nb, V, Ta)-based flat soft magnetic metal powder is dispersed so as to orient the flat face thereof in a direction perpendicular to a thickness direction of the composite magnetic sheet.

7. An oxide-coated Fe—Ni—(Nb, V, Ta)-based flat soft magnetic metal powder, comprising:

an Fe—Ni—(Nb, V, Ta)-based soft magnetic metal powder (hereinafter, referred to as an Fe—Ni—(Nb, V, Ta)-based flat soft magnetic metal powder); and an oxide film having a thickness in the range of 5 to 100 nm which is formed on the surface of the Fe—Ni—(Nb, V, Ta)-based flat soft magnetic metal powder, wherein the Fe—Ni—(Nb, V, Ta)-based flat soft magnetic metal powder includes a component composition which includes Ni in the range of 60 to 90 mass %, at least one of Nb, V, and Ta in the range of 5.4 to 20 mass % in total, and the balance including Fe and inevitable impurities; an average grain size in the range of 30 to 150 μm; an aspect ratio (average grain size/average thickness) in the range of 5 to 500; and a flat face, wherein a peak intensity ratio $I_{220}/I_{111}$ of the oxide-coated Fe—Ni—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—(Nb, V, Ta)-based flat soft magnetic metal powder, and an angle formed by the incidence direction and the flat face is equal to an angle formed by the diffraction direction and the flat face.

8. An oxide-coated Fe—Ni—(Nb, V, Ta)-based flat soft magnetic metal powder, comprising:

an Fe—Ni—(Nb, V, Ta)-based soft magnetic metal powder (hereinafter, referred to as an Fe—Ni—(Nb, V, Ta)-based flat soft magnetic metal powder); and an oxide film having a thickness in the range of 5 to 100 μm which is formed on the surface of the Fe—Ni—(Nb, V, Ta)-based flat soft magnetic metal powder, wherein the Fe—Ni—(Nb, V, Ta)-based flat soft magnetic metal powder includes a component composition which includes Ni in the range of 60 to 90 mass %, at least one of Nb, V, and Ta in the range of 5.4 to 20 mass % in total, least one of Al and Mn in the range of 0.01 to 1 mass % in total, and the balance including Fe and inevitable impurities; an average grain size in the range of 30 to 150 μm; an aspect ratio (average grain size/average thickness) in the range of 5 to 500; and a flat face, wherein a peak intensity ratio $I_{220}/I_{111}$ of the oxide-coated Fe—Ni—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—(Nb, V, Ta)-based flat soft magnetic metal powder, and an angle formed by the incidence direction and the flat face is equal to an angle formed by the diffraction direction and the flat face.

9. A composite magnetic material, comprising:

a resin; and the oxide-coated Fe—Ni—(Nb, V, Ta)-based flat soft magnetic metal powder according to claim 7, which is dispersed in the resin so as to orient the flat face thereof.

10. A composite magnetic material, comprising:

a resin; and the oxide-coated Fe—Ni—(Nb, V, Ta)-based flat soft magnetic metal powder according to claim 8, which is dispersed in the resin so as to orient the flat face thereof.

11. A composite magnetic sheet, comprising:

the composite magnetic material according to claim 9, wherein the oxide-coated Fe—Ni—(Nb, V, Ta)-based flat soft magnetic metal powder is dispersed so as to orient the flat face thereof in a direction perpendicular to a thickness direction of the composite magnetic sheet.

12. A composite magnetic sheet, comprising:

the composite magnetic material according to claim 10, wherein the oxide-coated Fe—Ni—(Nb, V, Ta)-based flat soft magnetic metal powder is dispersed so as to orient the flat face thereof in a direction perpendicular to a thickness direction of the composite magnetic sheet.

13. An Fe—Ni—Mo—(Nb, V, Ta)-based soft magnetic metal powder (hereinafter, referred to as an Fe—Ni—Mo—(Nb, V, Ta)-based flat soft magnetic metal powder), comprising:

a component composition which includes Ni in the range of 60 to 90 mass %, Mo in the range of 0.05 to 10 mass %, at least one of Nb, V, and Ta in the range of 5.4 to 19.95 mass % in total, and the balance including Fe and inevitable impurities;

an average grain size in the range of 30 to 150 μm;

an aspect ratio (average grain size/average thickness) in the range of 5 to 500; and a flat face, wherein a peak intensity ratio $I_{220}/I_{111}$, of the Fe—Ni—Mo—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the Fe—Ni—Mo—(Nb, V, Ta)-based flat soft magnetic metal powder, and an angle formed by the incidence direction and the flat face is equal to an angle formed by the diffraction direction and the flat face.

14. An Fe—Ni—Mo—(Nb, V, Ta)-based soft magnetic metal powder (hereinafter, referred to as an Fe—Ni—Mo—(Nb, V, Ta)-based flat soft magnetic metal powder), comprising:

a component composition which includes Ni in the range of 60 to 90 mass %, Mo in the range of 0.05 to 10 mass %, at least one of Nb, V, and Ta in the range of 5.4 to 19.95 mass % in total, at least one of Al and Mn in the range of 0.01 to 1 mass % in total, and the balance including Fe and inevitable impurities;

an average grain size in the range of 30 to 150 μm;

an aspect ratio (average grain size/average thickness) in the range of 5 to 500; and a flat face, wherein a peak intensity ratio $I_{220}/I_{111}$ of the Fe—Ni—Mo—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the Fe—Ni—Mo—(Nb, V, Ta)-based flat soft magnetic metal powder, and an angle formed by the incidence direction and the flat face is equal to an angle formed by the diffraction direction and the flat face.

15. A composite magnetic material, comprising:

a resin; and the Fe—Ni—Mo—(Nb, V, Ta)-based flat soft magnetic metal powder according to claim 13, which is dispersed in the resin so as to orient the flat face thereof.

16. A composite magnetic material, comprising:

a resin; and the Fe—Ni—Mo—(Nb, V, Ta)-based flat soft magnetic metal powder according to claim 14, which is dispersed in the resin so as to orient the flat face thereof.

17. A composite magnetic sheet, comprising:

the composite magnetic material according to claim 15, wherein the Fe—Ni—Mo—(Nb, V, Ta)-based flat soft magnetic metal powder is dispersed so as to orient the flat face thereof in a direction perpendicular to a thickness direction of the composite magnetic sheet.

18. A composite magnetic sheet, comprising:

the composite magnetic material according to claim 16, wherein the Fe—Ni—Mo—(Nb, V, Ta)-based flat soft magnetic metal powder is dispersed so as to orient the flat face thereof in a direction perpendicular to a thickness direction of the composite magnetic sheet.

19. An oxide-coated Fe—Ni—Mo—(Nb, V, Ta)-based flat soft magnetic metal powder, comprising:

an Fe—Ni—Mo—(Nb, V, Ta)-based soft magnetic metal powder (hereinafter, referred to as an Fe—Ni—Mo—(Nb, V, Ta)-based flat soft magnetic metal powder); and an oxide film having a thickness in the range of 5 to 100 μm which is formed on the surface of the Fe—Ni—Mo—(Nb, V, Ta)-based flat soft magnetic metal powder, wherein the Fe—Ni—Mo—(Nb, V, Ta)-based flat soft magnetic metal powder includes a component composition which includes Ni in the range of 60 to 90 mass %, Mo in the range of 0.05 to 10 mass %, at least one of Nb, V, and Ta in the range of 5.4 to 19.95 mass % in total, and the balance including Fe and inevitable impurities; an average grain size in the range of 30 to 150 μm; an aspect ratio (average grain size/average thickness) in the range of 5 to 500; and a flat face, wherein a peak intensity ratio $I_{220}/I_{111}$ of the oxide-coated Fe—Ni—Mo—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—Mo—(Nb, V, Ta)-based flat soft magnetic metal powder, and an angle formed by the incidence direction and the flat face is equal to an angle formed by the diffraction direction and the flat face.

20. An oxide-coated Fe—Ni—Mo—(Nb, V, Ta)-based flat soft magnetic metal powder, comprising:

an Fe—Ni—Mo—(Nb, V, Ta)-based soft magnetic metal powder (hereinafter, referred to as an Fe—Ni—Mo—(Nb, V, Ta)-based flat soft magnetic metal powder); and an oxide film having a thickness in the range of 5 to 100 μm which is formed on the surface of the Fe—Ni—Mo—(Nb, V, Ta)-based flat soft magnetic metal powder, wherein the Fe—Ni—Mo—(Nb, V, Ta)-based flat soft magnetic metal powder includes a component composition which includes Ni in the range of 60 to 90 mass %, Mo in the range of 0.05 to 10 mass %, at least one of Nb, V, and Ta in the range of 5.4 to 19.95 mass % in total, at least one of Al and Mn in the range of 0.01 to 1 mass % in total, and the balance including Fe and inevitable impurities; an average grain size in the range of 30 to 150 μm; an aspect ratio (average grain size/average thickness) in the range of 5 to 500; and a flat face, wherein a peak intensity ratio $I_{220}/_{111}$ of the oxide-coated Fe—Ni—Mo—(Nb, V, Ta)-based flat soft magnetic metal powder is in the range of 0.1 to 10, when it is assumed that a peak intensity of a face index (220) in an X-ray diffraction pattern is $I_{220}$ and a peak intensity of a face index (111) in the X-ray diffraction pattern is $I_{111}$, the X-ray diffraction pattern being measured in a state where a plane including an incidence direction and a diffraction direction of an X ray is perpendicular to the flat face of the oxide-coated Fe—Ni—Mo—(Nb, V, Ta)-based flat soft magnetic metal powder, and an angle formed by the incidence direction and the flat face is equal to an angle formed by the diffraction direction and the flat face.

21. A composite magnetic material, comprising:

a resin; and the oxide-coated Fe—Ni—Mo—(Nb, V, Ta)-based flat soft magnetic metal powder according to claim 19, which is dispersed in the resin so as to orient the flat face thereof.

22. A composite magnetic material, comprising:

a resin; and the oxide-coated Fe—Ni—Mo—(Nb, V, Ta)-based flat soft magnetic metal powder according to claim 20, which is dispersed in the resin so as to orient the flat face thereof.

23. A composite magnetic sheet, comprising:

the composite magnetic material according to claim 21, wherein the oxide-coated Fe—Ni—Mo—(Nb, V, Ta)-based flat soft magnetic metal powder is dispersed so as to orient the flat face thereof in a direction perpendicular to a thickness direction of the composite magnetic sheet.

24. A composite magnetic sheet, comprising:

the composite magnetic material according to claim 22, wherein the oxide-coated Fe—Ni—Mo—(Nb, V, Ta)-based flat soft magnetic metal powder is dispersed so as to orient the flat face thereof in a direction perpendicular to a thickness direction of the composite magnetic sheet.

25. The composite magnetic sheet of claim 5, wherein the powder has a value of permeability greater than 65.

* * * * *